US006956539B2

(12) United States Patent
Mamak et al.

(10) Patent No.: US 6,956,539 B2
(45) Date of Patent: Oct. 18, 2005

(54) MULTIPLE ANTENNA CONFIGURATION AND SUPPORT STRUCTURE

(75) Inventors: Walter J. Mamak, Lansing, IL (US); Kerry D. Scharp, Clifton, IL (US)

(73) Assignee: Electronics Research, Inc., Chandler, IN (US)

( * ) Notice: Subject to any disclaimer, the term of this patent is extended or adjusted under 35 U.S.C. 154(b) by 0 days.

(21) Appl. No.: 10/604,219

(22) Filed: Jul. 1, 2003

(65) Prior Publication Data

US 2005/0001782 A1 Jan. 6, 2005

(51) Int. Cl.[7] ..... H01Q 1/12
(52) U.S. Cl. ..... 343/890; 343/874
(58) Field of Search ..... 343/878, 874, 343/890, 893, 770; 52/40; 248/219.2

(56) References Cited

U.S. PATENT DOCUMENTS

| | | | | | |
|---|---|---|---|---|---|
| 5,200,759 | A | * | 4/1993 | McGinnis | 343/890 |
| 5,291,211 | A | * | 3/1994 | Tropper | 343/890 |
| 5,533,304 | A | * | 7/1996 | Noble | 52/40 |
| 5,954,305 | A | | 9/1999 | Calabro | 248/219.4 |
| 6,088,002 | A | | 7/2000 | Johnson et al. | 343/878 |
| 6,115,004 | A | | 9/2000 | McGinnis | 343/890 |
| 6,249,261 | B1 | * | 6/2001 | Solberg et al. | 343/801 |
| 6,275,197 | B1 | * | 8/2001 | Behr | 343/890 |
| 6,348,899 | B1 | * | 2/2002 | Bergstein | 343/890 |
| 6,492,959 | B1 | * | 12/2002 | Heatherwick et al. | 343/890 |
| 6,710,751 | B2 | * | 3/2004 | Ianello et al. | 343/890 |
| 2003/0201947 | A1 | * | 10/2003 | Boucher | 343/890 |

* cited by examiner

*Primary Examiner*—Tan Ho
(74) *Attorney, Agent, or Firm*—Eric R. Wandel; C. Richard Martin, Esq.

(57) ABSTRACT

A mounting configuration for a plurality of broadcast antennas that enables location of each antenna above the top of a support structure. Antenna spacing greater than the cross section of the support structure is obtained by mounting the antennas at either end of support beams extending beyond the support structure. Controlling antenna spacing improves RF signal patterns by reducing proximity to and thereby effects of nearby antennas and or support structure. Overturning moments of the antennas are reduced by mounting the antennas to the support beams at desired positions along their length, reducing structural requirements of the antennas and the support structure. Additional support may be obtained by also securing the antennas to a lower support beam.

23 Claims, 2 Drawing Sheets

MULTIPLE ANTENNA CONFIGURATION AND SUPPORT STRUCTURE

BACKGROUND OF INVENTION

1. Field of the Invention

This invention relates to the improvements in broadcast antennas and more particularly to a multiple antenna mounting configuration having reduced structural requirements.

2. Description of Related Art

Antennas are used in, for example, television broadcast systems. To provide an antenna with maximized omnidirectional coverage, the antenna is typically mounted at the top of a tower or other tall mounting structure. To avoid azimuth pattern degradation due to scattering effects of near metal objects, for example the structural supports and or other antennas, it is preferred that only a single antenna be mounted at a top of each tower or other support structure. However, growth of television, especially digital television, has increased the need for multiple antenna mountings with multiple radiation pattern arrangements on top of antenna towers or other antenna mounting structures.

Prior multiple tower top antenna mounting solutions include offset stack and or in line stacked antenna configurations. Offset stack antenna configurations generally have degraded azimuth patterns due to the proximity of the other, nearby, structure(s) and antenna feed lines. Stacked antennas add a significant structural requirement to the tower and or the individual antennas. An overturning moment that the stacked antenna exerts upon the tower at the antenna mounting point increases as the length of the antennas is increased, in a stacked configuration (each of the antenna structures being, for example 40 to 80 feet in length) the required structural reinforcement of both the antennas and the tower may make the overall cost prohibitive.

Another prior solution is integration of a lower antenna as a portion of the support structure for another antenna mounted above. In this solution, described in detail in U.S. Pat. No. 6,492,959, issued Dec. 10, 2002 to Heatherwick et al and hereby incorporated by reference in the entirety, because the antenna is part of the support structure for the above mounted antenna, the lower antenna cannot demand the same tower real estate lease rates as an antenna located at the highest point of the tower. Also, where more than two antennas are desired, the spacing of the third antenna either on top of the support structure or as another portion of the support structure, below the top mounted antenna(s), from the other antenna(s) is limited by the tower cross section dimensions.

Competition within the broadcast antenna industry has focused attention on signal quality, azimuth patterns, equipment and personnel costs, as well as time requirements for installation and maintenance of broadcast antenna systems.

Therefore, it is an object of the invention to provide an apparatus that overcomes deficiencies in the prior art.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
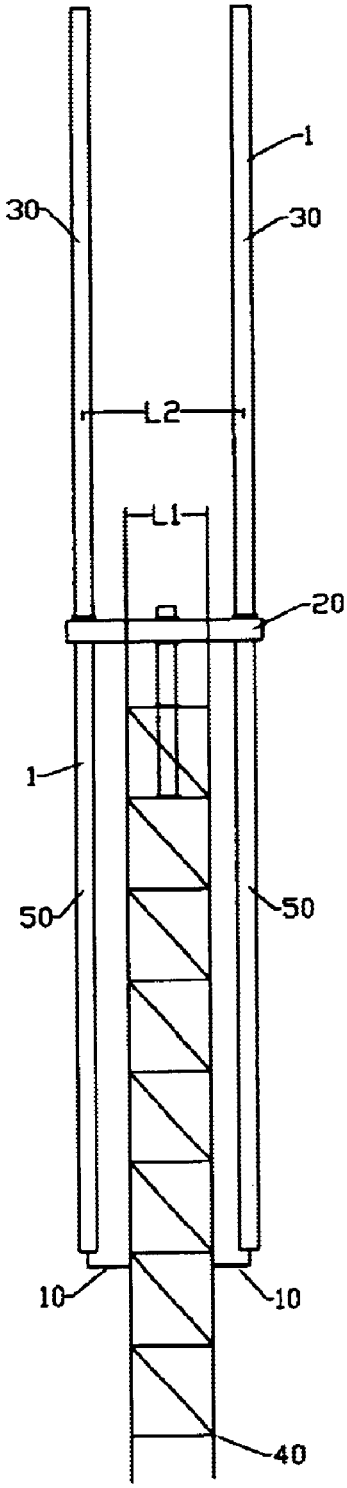
FIG. 1 is a side view of one embodiment of the invention.

For purposes of illustration, a two antenna 1 embodiment of the invention is shown in FIG. 1. The antenna(s) 1 may be, for example, UHF or VHF slotted array broadcast antennas, optimized for a desired channel and or frequency which couples the antenna to a transmitter (not shown). The antennas 1 are supported, for example, proximate a midpoint or other location selected for maximum structural and or RF efficiency of each antenna 1 by a support beam 20. Above the support beam 20, an upper section 30 of the antenna projects above the top of the tower structure 40 and a lower section 50 of the antenna extends below the top of the tower structure 40, spaced away from the tower structure 40.

A typical tower structure 40 may have, for example, a triangular configuration with a side dimension "L1". The antenna(s) 1 are located proximate either end of the support beam 20 at a distance "L2" from each other. In a standardized tower design, L1 may be 12 feet. Sizing the support beam so that "L2" is, for example, 18 feet, center to center of the antenna(s) 1, will space the lower portion 50 of each antenna 1 away from the tower structure 40 and reduce azimuth pattern degradation that may otherwise occur with respect to metallic elements of the tower structure 40 and or the other antenna 1. The selection of the length "L2" is a trade off between the reduction in azimuth pattern degradation as "L2" is increased and the necessary structural and cost considerations which will also increase as "L2" is increased.

The location of the support beam 20 along the antenna(s) 1 is shown in FIG. 1 approximately at the midpoint of the antenna(s) 1. One skilled in the art will appreciate that, when the antenna(s) 1 are mounted proximate their mid points, the overturning moment at the mounting point is counterbalanced by each end of the antenna(s) 1 so that there is zero local overturning moment to be resisted by the immediate support frame and the tower structural steel. Alternatively, the support beam 20 may be connected to the antenna(s) 1 with either a longer upper section 30 and or longer lower section 50. A longer upper section 30 maximizes overall antenna height but also increases the resulting structural moment upon the tower structure 40, requiring additional structural reinforcement of both the tower structure 40 and the antenna(s) 1. Conversely, a longer lower section 50 will utilize less of the possible maximum height available from the tower structure 40 but allow for a reduction in the structural requirements of both the antenna(s) 1 and the tower structure 40 while still having each of the antenna(s) 1 located arguably "at the top" of the tower structure 40.

Figure 2:
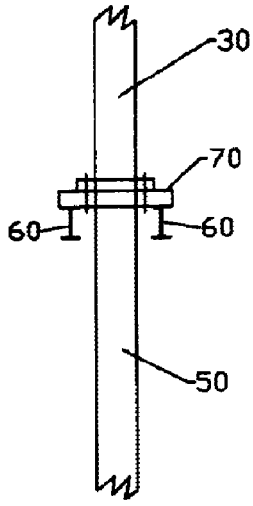
FIG. 2 is a partial section end view of FIG. 1 showing detail of the interconnection between the antenna and the support structure.
Figure 3:
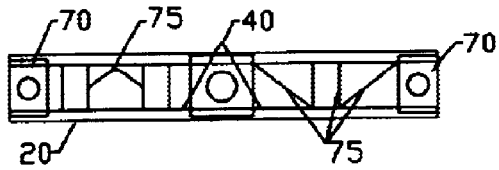
FIG. 3 is a top view of FIG. 1.

As shown in FIG. 2, the support beam 20 may be formed from one or more structural beams 60 adapted to form a base 70 of a, for example, flange mounting proximate either end of the structural beam(s) 60. The dimensions of the support beam 20 and the configuration of cross bracing 75 between each structural beam 60 (two possible cross bracing 75 configurations are shown, one on each side, for example, in FIG. 3) is dictated by the expected loads upon the support beam 20, which are a function of the support beam dimensions and the specific antenna(s) 1 which will be supported.

Figure 5:
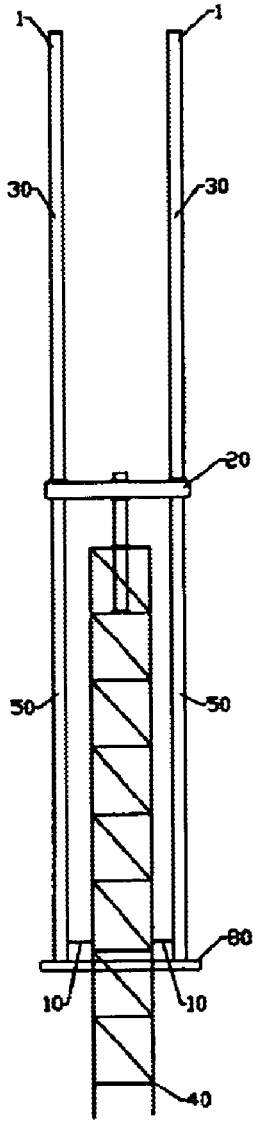
FIG. 5 is a side view of another embodiment of the invention, having a bottom support beam.

As shown in FIG. 5, a bottom support beam 80, or in the alternative a plurality of supports, may also be added at or near the bottom of the lower portion(s) 50, further reducing wind load requirements and or structural requirements of the antenna(s) 1 and the support beam 20. The structural design of each of the elements described is derived from engineering mechanics and strength of materials calculations well known to one skilled in the art and is therefore not described in detail herein.

Figure 6:
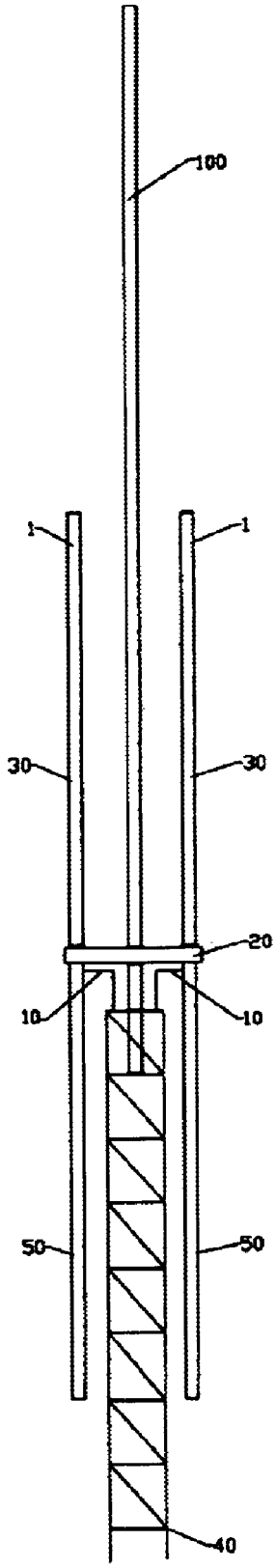
FIG. 6 is a side view of another embodiment of the invention, having three antennas.

The antenna feed 10, to each antenna 1 may be adapted to be supported by the bottom support beam 80 or may be provided with a limited support structure designed only to support the antenna feed 10. Alternatively, as shown in FIG. 6, the antenna(s) 1 may be configured with a "center" antenna feed 10 which is connected to each antenna 1 proximate the connection between the support beam 20, the upper section 30 and the lower section 50. With a "center" antenna feed 10, the lower section 50 of each antenna 1 may be configured without a bottom connection to the tower structure 40, allowing the lower section 50 to flex relative the support beam 20 and thereby absorb extreme wind loads.

Figure 4:
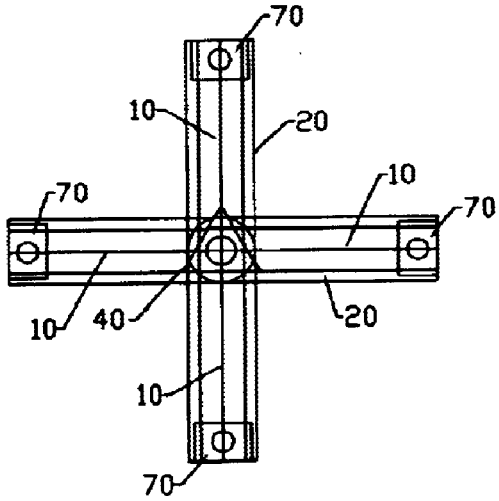
FIG. 4 is a top view of another embodiment of the invention, having four antennas.

In an alternative embodiment, as shown in FIG. 4, an additional pair of antennas may be mounted on the tower structure 40 by adding an additional support beam 20 in a generally perpendicular orientation with respect to the other support beam 20. A perpendicular orientation providing a generally equal distance between each of the antenna(s) 1. The additional support beam 20 may be integrated with the other support beam 20 to form a cross shaped integral support beam 20 or individual support beam(s) 20 may be applied, one stacked upon the other, possibly at a later date.

In still another embodiment, as shown in FIG. 6, a center antenna 100 may be added to a position proximate the midpoint of the support beam 20. The center antenna 100 may be, for example, a standard slotted array antenna with a bottom mounting. Azimuth pattern degradation due to scattering effects from the increased proximity to the nearby antenna(s) 1 may be limited by configuring the antenna(s) 1 to have shorter upper section(s) 30, as described herein above. Used with the support beam 20 embodiments shown in FIGS. 3 and 4, this embodiment may provide a total of three or five major broadcast antennas, respectively, on a single tower structure 40. However, because the center antenna 100 has no reduction in overturning moment due to having a traditional bottom mounting, significant reinforcement of the tower structure 40 may be necessary to provide support all of the antennas.

The present invention brings to the art a new and improved antenna mounting that provides multiple antenna mounts on a single tower structure 40 having improved inter-antenna spacing which reduces signal pattern degradation. Further, structural requirements for each antenna 1 and the tower structure 40 are reduced due to a significant decrease in the overturning moment of each antenna 1. Also, because each of the antennas rise above the top surface of the tower structure 40, tower real estate lease rates may be maximized.

Table of Parts

| | |
|---|---|
| 1 | antenna |
| 10 | antenna feed |
| 20 | support beam |
| 30 | upper section |

-continued

Table of Parts

| | |
|---|---|
| 40 | tower structure |
| 50 | lower section |
| 60 | structural beam |
| 70 | base |
| 75 | cross bracing |
| 80 | bottom support beam |
| 100 | center antenna |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicants general inventive concept. Further, it is to be appreciated that improvements and/or modifications may be made thereto without departing from the scope or spirit of the present invention as defined by the following claims.

What is claimed is:

1. A mounting configuration for a plurality of antennas, comprising:

a first antenna having a first length, first upper section, a first lower section and a first bottom end, the first antenna mounted proximate a first end of a first support beam at a first point along the first antenna between the first upper section and the first lower section;

a second antenna having a second upper section, a second lower section, and a second bottom end, the second antenna mounted proximate a second end of the first support beam at a second point along the second antenna between the second upper section and the second lower section, where the first support beam is connected to the top of a supporting tower structure proximate a midpoint between the first end of the first support beam and the second end of the first support beam.

2. The configuration of claim 1, wherein the first antenna and the second antenna are slotted array antennas.

3. The configuration of claim 1, wherein a first antenna feed is connected to the first bottom end and a second antenna feed is connected to the second bottom end.

4. The configuration of claim 1, wherein a first antenna feed is connected proximate the first point and a second antenna feed is connected proximate the second point.

5. The configuration of claim 1, wherein the first bottom end and the second bottom end are connected to a second support beam.

6. The configuration of claim 1, wherein a second support beam is attached to the first antenna between the first point and the first bottom end and to the second antenna between the second point and the second bottom end.

7. The configuration of claim 1, wherein a third antenna having a third bottom end is mounted to the first support beam at the third bottom end proximate a midpoint of the first support beam.

8. The configuration of claim 1, wherein the first point is proximate a midpoint of the first antenna.

9. The configuration of claim 1, wherein the first point is proximate a position ¼ of the first length from the first bottom end.

10. The configuration of claim 1, wherein the first point is proximate a position ⅓ of the first length from the first bottom end.

11. The configuration of claim 1, wherein the first point is proximate a position ⅔ of the first length from the first bottom end.

12. The configuration of claim 1, wherein the first point is proximate a position ¾ of the first length from the first bottom end.

13. The configuration of claim 1, wherein the first support beam is comprised of a plurality of structural beams interconnected by cross bracing and having a first base proximate the first end and a second base proximate the second end, the first base configured to support the first antenna and the second base configured to support the second antenna.

14. The configuration of claim 1, further including:

a third antenna having a third length, third upper section, a third lower section and a third bottom end, the third antenna mounted proximate a third end of a third support beam at a third point along the third antenna between the third upper section and the third lower section, a fourth antenna having a fourth upper section, a fourth lower section, and a fourth bottom end, the fourth antenna mounted proximate a fourth end of the third support beam at a second point along the fourth antenna between the fourth upper section and the fourth lower section; and the third support beam arranged in a generally perpendicular orientation to the first support beam.

15. The configuration of claim 14, wherein the first support beam and the third support beam are joined, proximate a midpoint of the first support beam and the third support beam.

16. The configuration of claim 14, wherein the first support beam is mounted above the third support beam.

17. The configuration of claim 14, wherein a center antenna having a fifth bottom end is mounted to the first support beam at the fifth bottom end proximate a midpoint of the first support beam.

18. The configuration of claim 14, wherein the third support beam is connected to a tower structure.

19. A mounting configuration for a plurality of antennas, comprising:

a first antenna having a first length, first upper section, a first lower section and a first bottom end, the first antenna mounted proximate a first end of a first support beam at a first point along the first antenna between the first upper section and the first lower section;

a second antenna having a second upper section, a second lower section, and a second bottom end, the second antenna mounted proximate a second end of the first support beam at a second point along the second antenna between the second upper section and the second lower section, where the first support beam is connected to the top of supporting tower structure proximate a midpoint between the first end of the first support beam and the second end of the first support beam, where the supporting tower structure has a side dimension less than a length of the first support beam.

20. The mounting configuration of claim 19, wherein the first antenna and the second antenna are slotted array antennas.

21. The mounting configuration of claim 19, wherein the support beam is mounted at a midpoint of the support beam to a centerpoint of the tower.

22. The mounting configuration of claim 21, further including a second support beam supporting a third antenna and a fourth antenna, the second support beam mounted to the first support beam at the centerpoint of the tower in a generally perpendicular orientation to the first support beam.

23. The mounting configuration of claim 19, further including a center antenna having a bottom; the bottom mounted to a midpoint of the support beam.

* * * * *